United States Patent [19]

Feldman

[11] 4,325,599

[45] Apr. 20, 1982

[54] PHONE PLUG

[75] Inventor: Steven Feldman, Seminole, Fla.

[73] Assignee: AMP Incorporated, Harrisburg, Pa.

[21] Appl. No.: 100,667

[22] Filed: Dec. 5, 1979

[51] Int. Cl.[3] ..... H01R 11/08

[52] U.S. Cl. ..... 339/103 R; 339/183; 339/276 T

[58] Field of Search ..... 339/103, 45, 46, 109, 339/182, 183, 276

[56] References Cited

U.S. PATENT DOCUMENTS

| | | | |
|---|---|---|---|
| 2,054,465 | 9/1936 | Ouellet | 339/182 R |
| 2,104,945 | 1/1938 | Guinn | 339/182 R |
| 2,240,098 | 4/1941 | Morin | 339/182 R |
| 3,024,295 | 3/1962 | Moore | 339/182 R |

FOREIGN PATENT DOCUMENTS

| | | | |
|---|---|---|---|
| 395369 | 5/1924 | Fed. Rep. of Germany | 339/183 |

*Primary Examiner*—Joseph H. McGlynn
*Attorney, Agent, or Firm*—F. Brice Faller

[57] ABSTRACT

A phone plug is disclosed having an elongated dielectric plug body with electrically conductive surfaces situated coaxially in tandem thereon. The plug body has bores entering from one end to communicate with discrete areas on the surface of the plug body, whereby pre-stripped conductors are fed into the bores until the exposed ends protrude at the areas, an apertured tubular sleeve of conductive material is slid over the body, and the sleeve is sheared at the apertures and crimped to form isolated conductive surfaces on the discrete areas of the plug.

8 Claims, 6 Drawing Figures

PHONE PLUG

BACKGROUND OF THE INVENTION

1. The Field of the Invention

Phone plugs of the type concerned herein have electrically isolated conductive surfaces tandemly situated along a common axis. Of primary concern are two and three conductor type phone plugs having all points on the conductive surfaces equally spaced from the axis, whereby each contact will make electrical connection with its mating contact regardless of the angular disposition of the coupling part about the axis of engagement.

2. The Prior Art

Prior art phone plugs of the two conductor type generally have a conductive center contact pin concentrically situated within a hollow conductive cylinder and isolated from it by dielectric spacers. A common type has a pin in the form of a bolt which threads into a piece which forms the nose of the plug; the nose sits on a dielectric washer which isolates it from the end of the cylinder. The head of the bolt carries contact arms which are isolated from each other by a second dielectric washer; one arm is in electrical contact with the cylinder, the other is in electrical contact with the bolt. The arms are adapted for connection to electrical wires by soldering or screws; a sheath for protection of the arms and plug handling purposes is threaded to the conductive cylinder.

A common type of prior art three conductor plug is similarly assembled, with an additional hollow conductive cylinder between the nose and the first cylinder. This has a tubular extension which fits between the first cylinder and the center pin. Additional dielectric spacers and an additional contact arm are utilized.

The currently used phone plugs, including those described briefly above, are generally satisfactory in performance but involve a large number of parts and complicated manufacturing steps. Further, they do not lend themselves well to rapid assembly and are relatively expensive to make.

SUMMARY OF THE INVENTION

The instant invention involves an improved phone plug and its method of manufacture and assembly. An elongated dielectric plug body is molded from a suitable thermoplastic material with bores entering from one end thereof. These bores communicate with discrete surface areas towards the opposite end of the plug and permit the protrusion of exposed ends of pre-stripped insulated conductors which have been fed into the bores from the one end. A tubular sleeve of conductive material having apertures therein is telescopically received over the plug body, aligned with the discrete areas and features of the dielectric body, and the sleeve is then sheared at the apertures to be firmly crimped or staked to the body to form electrically isolated conductive surfaces on the plug body. The subject plug also includes strain relief for the conductors and handling convenience including remote removal and flexibility to avoid dislocation and/or damage.

An object of the present invention is to provide a phone plug which involves fewer parts and is less expensive to manufacture.

Another object is the provision of a plug body which may be molded as one piece from a dielectric material.

A further object is provision of contact surfaces on a phone plug which may be stamped and formed from planar sheets of conductive material.

An additional object is the elimination of solder and screws as connection means for lead wires to a phone plug.

Another object is an improved method of assembly of a phone plug which is easier and less time consuming.

The means for accomplishing the foregoing objects and other advantages of the present invention will be apparent from the following detailed description taken together with the accompanying drawings.

DESCRIPTION OF THE PREFERRED EMBODIMENT

Figure 1:
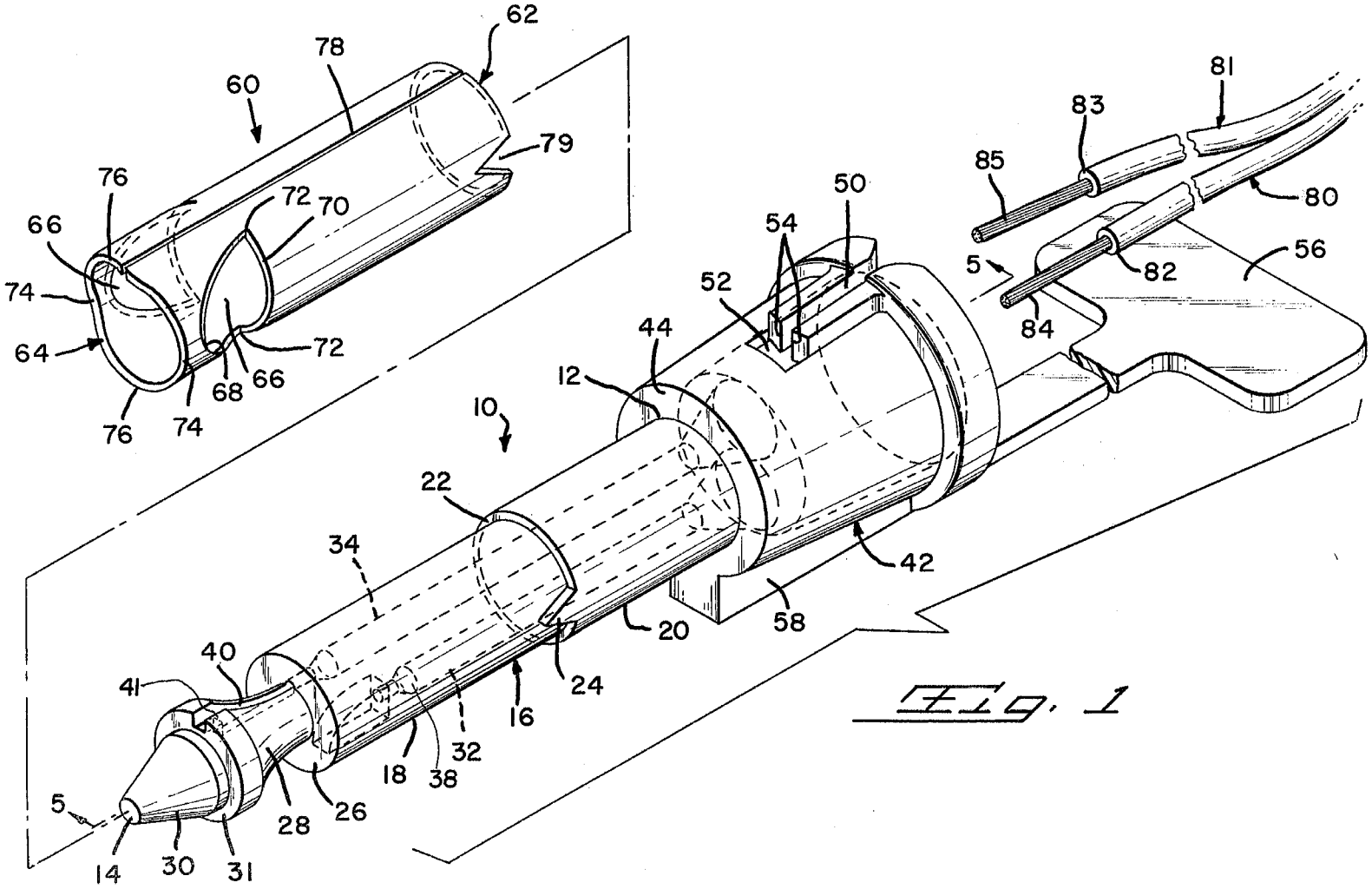
FIG. 1 is a fully exploded perspective view of the components of a phone plug according to the present invention.

Referring to FIG. 1, the preferred form of dielectric plug body 10 has an end 12, a second end 14, and a shaft 16 therebetween. The shaft has first and second cylindrical surfaces 18, 20 thereon which are separated by a first annular shoulder 22, which lies in a plane generally perpendicular to the axis of the shaft. The second surface 20 is slightly larger in diameter than the first surface and lies between the first end and the annular shoulder 22, except for a triangular protrusion 24 of the second surface over the first. The first cylindrical surface 18 lies between the annular shoulder 22 and a converging shoulder 26 which converges sharply radially inwardly to a neck 28 before diverging radially outward to define a nose 30. The nose 30 is of substantially the same diameter as the first cylindrical surface 18 and tapers forwardly to a second end 14 to facilitate pushing the plug into a phone jack (not shown). Note that the nose 30 has an annular groove 31 adjacent to and forward of its greatest diameter, at the beginning of the taper.

Figure 5:
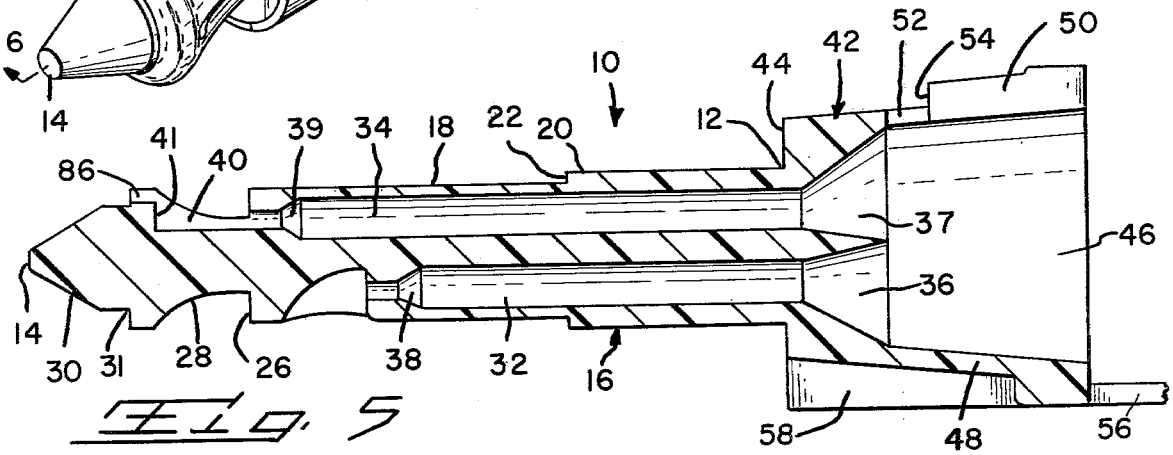
FIG. 5 is a longitudinal cross-sectional view of the dielectric body taken along the lines 5—5 of FIG. 1.

Referring to FIG. 5, first and second bores 32, 34 extend into the first end 12 of the shaft 16 through flared openings 36, 37 respectively. First bore 32 bears parallel to the axis of the shaft to funnel 38 where it narrows, then the first bore arcs away from the axis to communicate with the first cylindrical surface 18 at a point proximate to the converging shoulder 26. Second bore 34 bears parallel to the axis of the shaft opposite the first bore. It narrows at funnel 39 then emerges through the converging shoulder 26 and terminates at the blind end 41 of groove 40 in the neck 28.

A base 42 is integral with the plug body 10 at first end 12 and comprises an abutting wall 44, a mouth 46 and a circumferential wall 48. Extending into the circumferential wall 48 from the mouth 46 is a slot 50 which terminates in a profiled hole 52 in the circumferential wall. Points 54 extend from the circumferential wall into the hole from either side of the slot 50. On the opposite side of the base 42 from the slot 50 is a pull tab 56 which extends away from the mouth 46; the pull tab terminates in a key 58 integrally formed extending radially outwardly from the circumferential wall.

Referring again to FIG. 1, an electrically conductive tubular sleeve 60 has a first end 62 and a second end 64 and has an integral diameter which is slightly larger than the outer diameter of the first cylindrical surface 18 of the plug body 10. In the preferred embodiment this sleeve is stamped and formed from conductive sheet metal, but it may also be manufactured from tubing, drawn from sheet, cast, or machined. The sleeve has two identical triangular apertures 66 therein on opposite sides thereof which are proximate to the second end 64 and have rounded apexes 68 which are closest to the second end of the sleeve. Opposite the apexes are sides 70 which both lie in a single plane perpendicular to the axis of the sleeve 60. At either end of the sides 70 are sharp corners 72.

Other features of the tubular sleeve 60 include a seam 78 which necessarily results from forming from sheet, and a triangular notch 79 in first end 62. The first end 62 lies in a plane perpendicular to the axis of the sleeve, but the second end 64 undulates slightly from such a plane, having concave sections 74 adjacent the apexes 68 and convex sections 76 located 90 degrees off the apexes.

The plug design contemplates termination of conductors which are pictured in the preferred embodiment as first and second conductors 80, 81, however, it should be noted that a coaxial cable could also be terminated by exposing the center conductor and a drain wire from the braided shield.

The plug of the preferred embodiment is assembled by first stripping insulating sheaths 82, 83 from first and second conductors 80, 81 to expose ends 84, 85. First conductor 80 is then inserted in first bore 32 of the dielectric plug body 10 until the insulating sheath 82 is stopped by funnel 38, and exposed end 84 protrudes from first cylindrical surface 18 (see FIGS. 2 and 5). Second conductor 81 is inserted in second bore 34 until exposed end 85 is stopped by the blind end 41 of the groove 40 in the neck 28.

Figure 2:
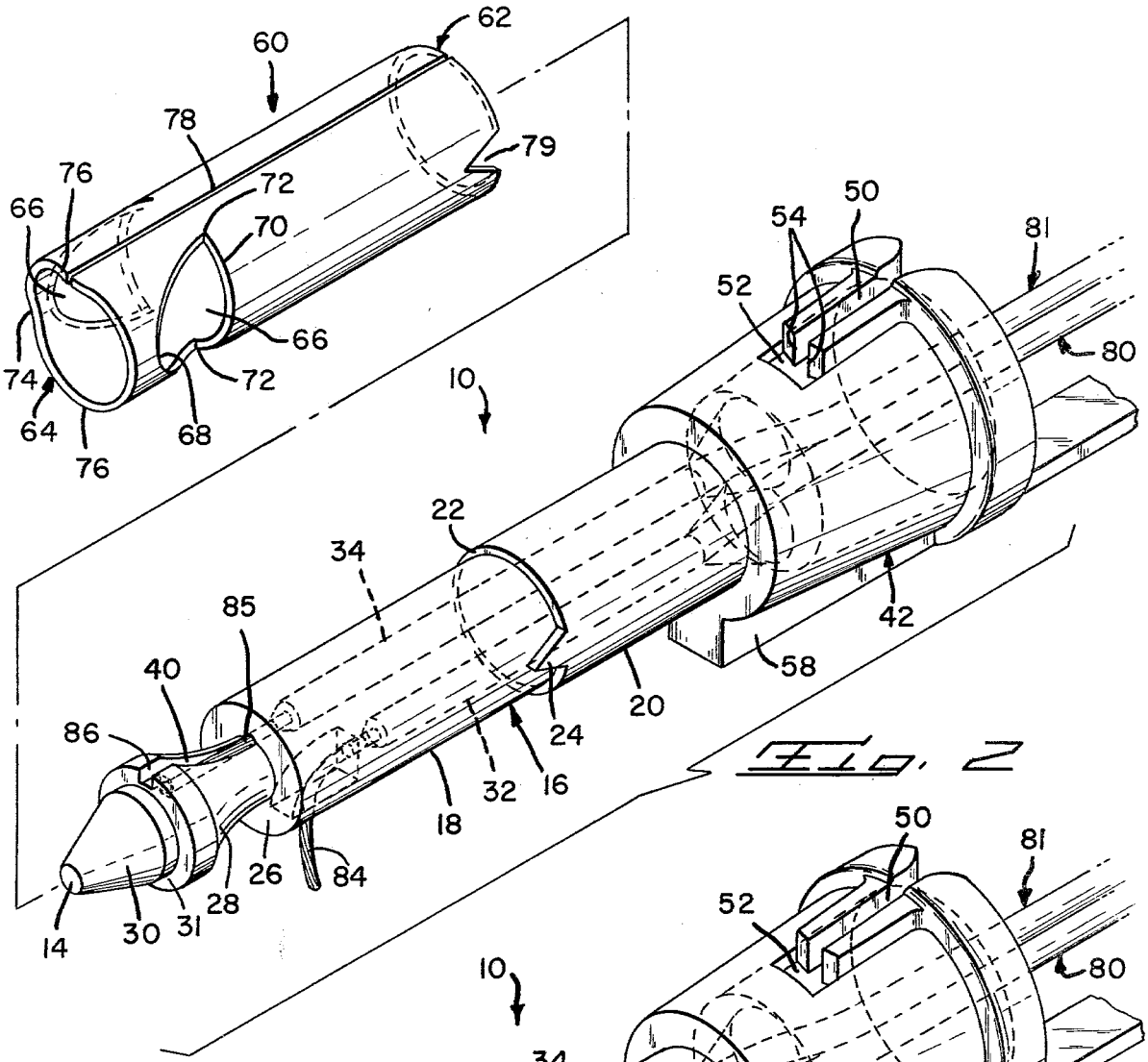
FIG. 2 is a view similar to FIG. 1 with two conductors inserted in the plug body.

Once the conductors are in place, as shown in FIG. 2, the tubular sleeve 60 is telescopically received over the second end 14 of the plug body 10 until the first end 62 of the sleeve abuts the shoulder 22, and the triangular notch 79 of the sleeve engages the triangular protrusion 24 on the shoulder. Note that the outside diameter of the tubular sleeve 60 is substantially the same diameter as the second cylindrical surface 20 so that the sleeve abuts the shoulder 22 flushly. The inside diameter of the tubular sleeve is slightly larger than the outer diameter of the first cylindrical surface to allow room for the exposed end 84 of the first conductor 80, to be forced back toward the shoulder 22 by the passage of sleeve 60. The length of wire 84 which has been stripped is important because the exposed end must not reach the shoulder 22 where it could prevent the flush fit of the sleeve. Note from FIG. 3, that the sides 70 of the triangular apertures 66 are substantially aligned with the converging shoulder 26, and the second end 64 aligns with the annular groove 31 in the nose 30.

Figure 3:
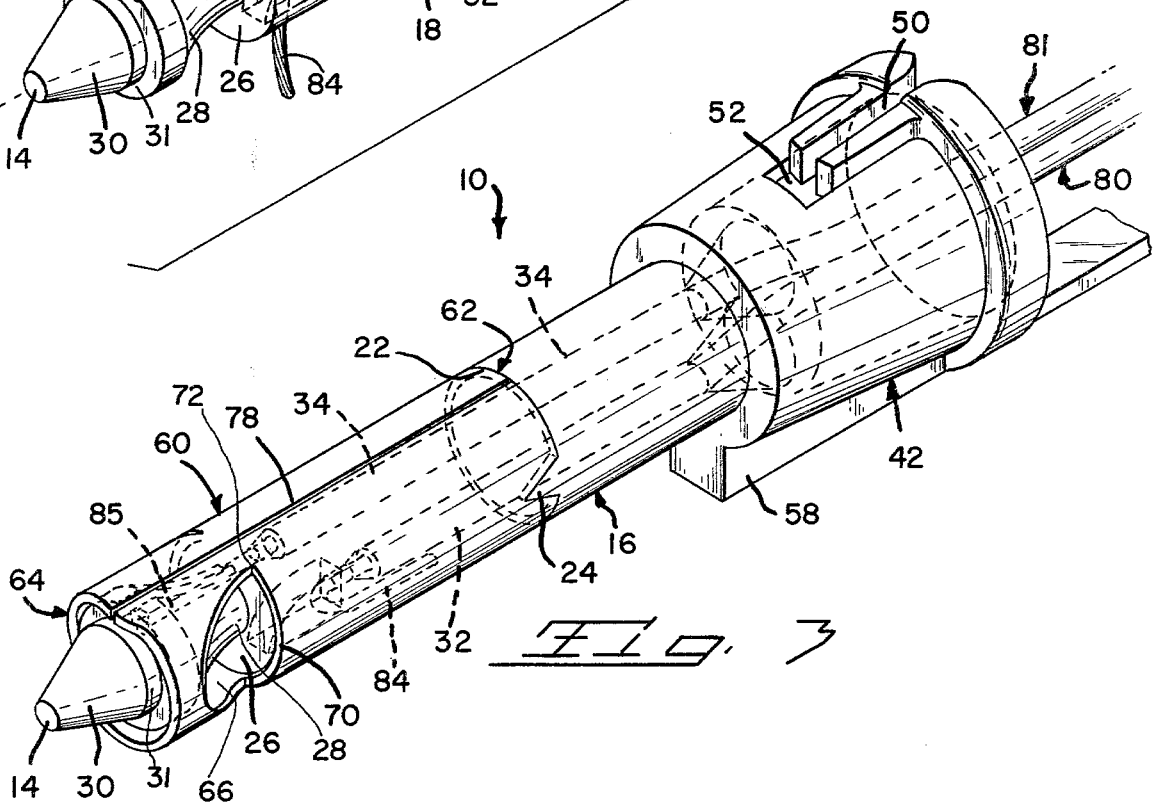
FIG. 3 is a view similar to FIGS. 1 and 2 with the tubular sleeve positioned over the plug body.
Figure 6:
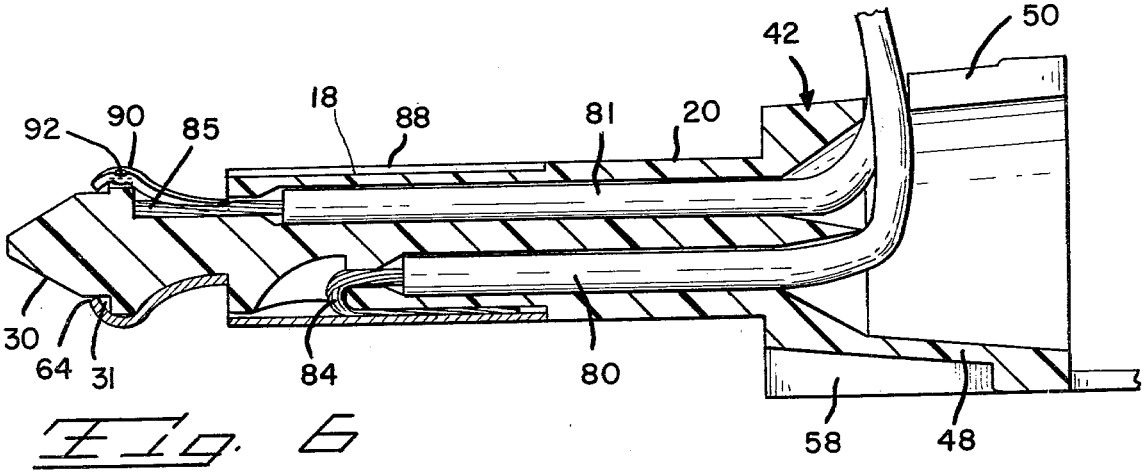
FIG. 6 is a longitudinal cross-sectional view of the assembled plug taken along the lines 6—6 of FIG. 4.

The plug assembly, at the stage shown in FIG. 3, is ready to be crimped and is placed in crimping dies on a hand tool arbor press, hydraulic press, or like tool. Points on the dies enter each of the four corners 72 of the triangular apertures 66. As crimp pressure is applied, the dies shear the sleeve at the converging shoulder 26, collapsing the sheared portions of the sleeve about the neck 28 while closing the triangular apertures. The shearing apart of the sleeve electrically isolates first and second conductive surfaces 88, 90 which are formed about the first cylindrical surface 18 and nose 30, respectively (see FIGS. 4 and 6). Note that as the sleeve is collapsing into the neck 28, the convex sections 76 on the second end 64 of the sleeve are deformed slightly and fall into the same plane as the concave sections 74. The next step in the crimping operation occurs as pressure is radially applied to the second end 64 of the sleeve to deform it into annular groove 31 on the nose 30 to form a substantially smooth transition between the nose 30 and the second conductive surface 90. The final step forms dimples at points 92 and 94, FIG. 4, to fix the conductors against any movement during insertion of the plug into and extraction from a jack (not shown).

Figure 4:
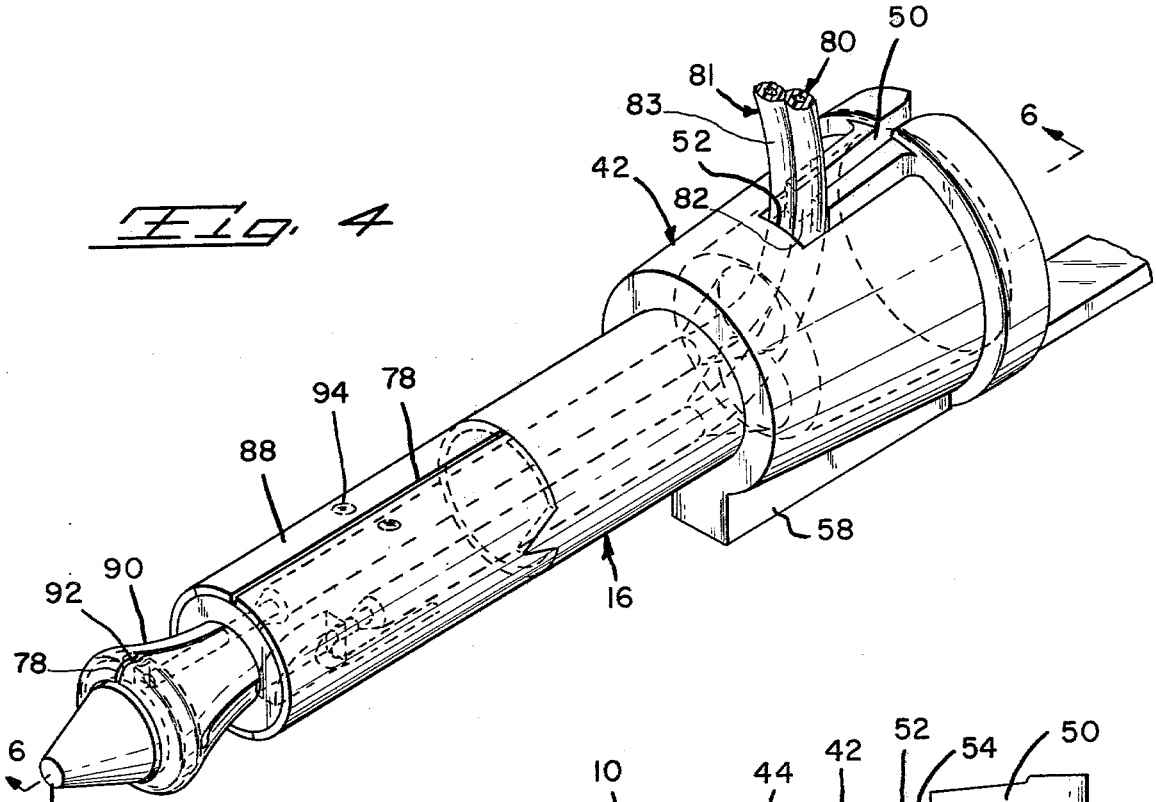
FIG. 4 is a perspective view of the assembled phone plug according to the present invention.

Referring now to FIG. 4, after crimping the conductors 80, 81 are drawn sideways into slot 50 until they lie in hole 52. The points 54 provide a grip on the sheaths 82, 83 (FIGS. 4 and 6), thereby providing strain relief which guards against conductors 80, 81, being withdrawn from crimped contact with conductive surfaces 88, 90, respectively.

Alignment and interaction of various features of the plug body and sleeve are important in its assembly. The second bore 34 is in line with the slot 50 in the base of the plug; the first bore 32 is 180° from the second bore relative to the axis of the plug body and in a line with the pull tab 56 and key 58. The notch 79 and protrusion 24 are positioned so that the seam 78 lies over second bore 34. The seam towards the second end 64 is crimped slightly into the groove 40 in the neck which causes it to mash into the exposed end of 85 of the second conductor, leaving strands exposed in the seam. This gives the second conductive surface 90 some spring action to retain exposed end 85 in groove 40, provides more positive contact between the exposed end 85 and the conductive surface 90, and allows for visual inspection to be sure the exposed end has not pulled out of contact with the seam during the strain relief operation. The crimping of the seam 78 into the groove 86 also prevents the angular rotation of the second conductive surface 90 about the nose 30. Alignment of the plug body in the crimping dies is achieved by the key 58 to assure that the four die points will enter the respective four corners 72. The strain relief means in the form of slot 50 is opposite the first bore 32 so that the first conductor 80 will have a longer length to the strain relief than the second conductor. This arrangement is desirable since the first conductor is more firmly retained in contact with the first conductive surface than the second conductor is retained by the second conductive surface.

Plugs of the type involved here are generally standardized in dimension, e.g., a "$\frac{1}{4}$ in." plug has a shaft $\frac{1}{4}$ in. (6.35 mm) in diameter and 1 in. (25.4 mm) between the base and the neck. This permits use in a standard jack with a spring contact positioned to mate with the neck when the plug is fully inserted in the jack, which also serves to retain the plug in the jack. While the foregoing detailed description describes a two conductor phone plug, a three conductor phone plug as contemplated by this invention would also have one neck and be of substantially the same shape, with an additional conductive surface between the base and the converging shoulder. A three conductor plug is commonly referred to as a stereo plug, since it is used to terminate two signal leads and a ground lead.

It should be noted that the configuration of the base 42 is short compared with standard plugs and has a long flexible pull tab 56. Thus, the subject phone plug can be utilized in portable equipment and can absorb glancing blows in a plugged in condition without either being damaged or dislodged. Further, the subject plug can be applied to recessed jacks leaving only the pull tab 56 exposed and available as a means to remove the plug.

Alternative embodiments of the invention are primarily concerned with alternative means of providing conductive surfaces. The tubular sleeve may be manufactured from tubing, or the surfaces may be applied as a conductive ink or vacuum deposition of plate over discrete areas. The latter two methods would, of course, necessitate alternative means for retaining the exposed ends of the conductors in contact with the conductive surfaces.

It will be understood that other variations and modifications may be effected without departing from the spirit and scope of the novel concepts of this invention.

What is claimed is:

1. Phone plug components for the coaxial in-tandem termination of first and second conductors, said phone plug components comprising:

a dielectric body having a first end, a second end, and a shaft lying between said ends, said shaft having a first cylindrical surface thereon, said shaft having a shoulder which converges sharply radially inward from the first cylindrical surface to a neck which is proximate to said second end, said neck diverging radially outward to a nose which forms said second end and is of substantially the same diameter as the first cylindrical surface, said dielectric body further having first and second bores extending into said first end of said shaft, said first bore communicating with said first cylindrical surface, said second bore communicating with said neck;

an electrically conductive tubular sleeve having an inside diameter substantially equal to the outer diameter of the first cylindrical surface, said sleeve having apertures therein proximate to one end thereof; whereby upon locating said first and second conductors through said first and second bores respectively, and locating said tubular sleeve over said shaft until said apertures are proximate to said neck, and compressing said sleeve until it shears at said converging shoulder and collapses about said neck, electrically isolated first and second conductive surfaces are formed, said first conductive surface around said first cylindrical surface and in contact with said first conductor, said second conductive surface around said neck and in contact with said second conductor.

2. Phone plug components according to claim 1 further comprising:

first means assuring fixation of said first conductive surface to said first cylindrical surface against both longitudinal and rotational movement; and second means assuring fixation of said second conductive surface to said neck and nose against both longitudinal and rotational movement.

3. A phone plug as in claim 1 wherein said shaft has an annular shoulder thereon which defines a second cylindrical surface lying between the first end and the annular shoulder, said first cylindrical surface lying between the annular shoulder and the converging shoulder, said second cylindrical surface being of slightly larger diameter than the first cylindrical surface, whereby the tubular sleeve fits over the first cylindrical surface and abuts the annular shoulder flushly with the second cylindrical surface.

4. Phone plug components as in claim 3, wherein said bores have funnels which narrow the bores remote from said first end, said bores between said first end and said funnels being sized to accommodate conductors with insulating sheaths thereon, said funnels being sized to narrowly accommodate said conductors without said sheaths, whereby upon inserting pre-stripped conductors in said bores only predetermined lengths of conductors will pass through the bores.

5. Phone plug components as in claim 4 which further includes a base at said first end of said shaft, said base having a wall abutting the first end, a mouth, and a circumferential wall therebetween, said circumferential wall having strain relief means therein.

6. Phone plug components as in claim 5 wherein said circumferential wall is short with a flexible grip extension whereby chances of breakage or dislocation of the plugged in plug from glancing blows are substantially reduced.

7. Phone plug components as in claim 5 said strain relief means comprising:

an aperture in said circumferential wall and a slot leading from the free edge of said wall to said aperture, the wall portions defining said slot terminating in pointed projections directed into said aperture, said slot being sized to closely accommodate a single conductor, said aperture being sized to closely accommodate two conductors, whereby conductors passed through said slot into said aperture will be retained therein in strain relieving fashion.

8. Phone plug components as in claim 5 further comprising:

a key extending integrally outwardly from said base; and pull tab means extending rearwardly from said key whereby removal of said plug from an associated jack is facilitated.

* * * * *